US005257522A

United States Patent [19]

Miki et al.

[11] Patent Number: 5,257,522

[45] Date of Patent: Nov. 2, 1993

[54] PROCESS OF HOT FORGING AT ULTRAHIGH TEMPERATURE

[75] Inventors: Takeshi Miki; Masahiro Toda, both of Futtsu, Japan

[73] Assignee: Nippon Steel Corporation, Tokyo, Japan

[21] Appl. No.: 905,737

[22] Filed: Jun. 29, 1992

[30] Foreign Application Priority Data

Jul. 9, 1991 [JP] Japan ..... 3-193572

[51] Int. Cl.[5] ..... B21J 1/06

[52] U.S. Cl. ..... 72/342.5; 72/342.8; 72/364

[58] Field of Search ..... 72/342.6, 342.8, 342.94, 72/342.2, 364, 342.5; 148/649, 648

[56] References Cited

U.S. PATENT DOCUMENTS

| | | | |
|---|---|---|---|
| 3,806,378 | 4/1974 | Bramfitt et al. | 148/648 |
| 3,857,741 | 12/1974 | Hultgren et al. | 148/648 |
| 4,016,740 | 4/1977 | Gondo et al. | 72/364 |
| 4,936,926 | 6/1990 | Matsumoto et al. | 148/648 |
| 5,037,489 | 8/1991 | Kirkwood et al. | 148/649 |

FOREIGN PATENT DOCUMENTS

| | | | |
|---|---|---|---|
| 0051116 | 5/1978 | Japan | 148/649 |
| 1407976 | 7/1988 | U.S.S.R. | 72/364 |
| 2070481 | 9/1981 | United Kingdom . | |
| 2094196 | 9/1982 | United Kingdom . | |

OTHER PUBLICATIONS

Patent Abstracts of Japan, vol. 10, No. 159 (M-486) (2215) Jun. 7, 1986.

Patent Abstracts of Japan, vol. 9, No. 111 (M-379) (1834) May 15, 1985.

"Structure and properties of Thixocast steels", K. P. Young, R. G. Riek, M. C. Flemings, Metals Technology, Apr., 1979, pp. 130-137.

"Processing-Structure Characterization of Rheocast IN-100 Super Alloy", J-J. A. Cheng, D. Apelian, R. D. Doherty, Metallurgical Transaction A, vol. 17A, Nov., 1986, pp. 2049-2062.

*Primary Examiner*—Lowell A. Larson
*Assistant Examiner*—Michael J. McKeon
*Attorney, Agent, or Firm*—Kenyon & Kenyon

[57] ABSTRACT

A process of hot forging a steel at an ultrahigh temperature, comprising the steps of: heating a steel containing less than 1 wt % carbon in an atmosphere substantially composed of a non-oxidizing gas at a high heating rate sufficient for suppressing the oxidation of the steel caused by a residual oxidizing impurity gas in the atmosphere to a temperature either within or slightly below a range in which the steel has a solid-liquid dual phase structure; and forging the heated steel in a hot forging die at a high working speed in accordance with a preheating temperature of the die so that the steel is maintained at a temperature necessary for imparting the steel with a formability necessary for effecting the forging until a desired form is attained.

6 Claims, 1 Drawing Sheet

PROCESS OF HOT FORGING AT ULTRAHIGH TEMPERATURE

BACKGROUND OF THE INVENTION

1. Field of the Invention

The present invention relates to a process of forging a steel, particularly steel articles having a complicated shape such as connecting rods and other load bearing parts used for the foot assembly of automobiles and construction equipment.

2. Description of the Related Art

The conventional processes for producing machine parts by forging steel include hot forging, warm forging, and cold forging. Small articles having a simple shape are produced by cold forging and large articles having a complicated shape are produced by hot forging. Warm forging is partially used for the high precision forming of stainless steel and other materials having a high resistance to deformation.

The recent trend of minimizing the weight of machine parts including those of automobiles necessitates steel materials with greater strength achieved by the addition of alloying elements in steel, resulting in an increased resistance to deformation under which a tool cannot stand. Moreover, a section modulus compensating for a reduction in stiffness due to weight reduction requires a complicated article shape causing a further reduction in the life of the tools used for forming thereof.

To solve this problem, it might be possible to reduce the resistance to deformation by using an elevated forging temperature higher than the conventional temperature of from 1000° to 1250° C., but this is not practically advantageous and is not actually used because the elevated temperature causes an intense oxidation of steel during heating and forging thereof with a resulting degradation in product yield, article precision and surface quality and because the formability of steel is not remarkably improved as expected because of a rapid drop of the material temperature when brought into contact with a forging die.

Such an elevated temperature forging is only reported on page 11 of "SEISAN-KENKYU (Study of Manufacture)", February, 1990, vol. 42, No. 2, published by Institute of Industrial Science, University of Tokyo, in which a cast iron is heated to a half-molten state and forged. The half-molten state enables a material which is otherwise unforgeable to be forged without the occurrence of cracking. A cast iron can be brought into a half-molten state by heating to about 1000° C., which is not higher than normal temperatures used in forging of steels, and no particular measures are taken to control the heating condition and atmosphere for suppressing the oxidation and the working condition for improving the formability.

A steel has a melting point far higher than that of a cast iron and is not forged at a temperature close to the melting point thereof because of the above-mentioned problems.

A cast iron is, of course, not applicable as a material for strength parts or load bearing parts necessary for automobiles, etc.

SUMMARY OF THE INVENTION

The object of the present invention is to provide a process of forging a steel, the process being advantageously applicable when producing high strength, light weight machine parts, in which an ultrahigh temperature is used while ensuring good tool life and product precision.

To achieve the above object according to the present invention, there is provided a process of hot forging a steel at an ultrahigh temperature, comprising the steps of:

heating a steel containing less than 1 wt % carbon in an atmosphere substantially composed of a non-oxidizing gas at a high heating rate sufficient for suppressing the oxidation of the steel caused by a residual oxidizing impurity gas in the atmosphere to a temperature either within or slightly below a range in which the steel has a solid-liquid dual phase structure; and forging the heated steel in a hot forging die at a high working speed in accordance with a preheating temperature of the die so that the steel is maintained at a temperature necessary for imparting the steel with a formability necessary for effecting the forging until a desired form is attained.

The present inventive process makes it possible to forge a steel under an ultrahigh temperature, which was not conventionally applicable, by the combined use of a non-oxidizing atmosphere to essentially prevent the oxidation of steel and rapid heating and forging to further suppress the oxidation of steel which would otherwise be caused by an oxidizing impurity unavoidably present in the non-oxidizing atmosphere; the rapid forging simultaneously ensuring that a desired forming of the steel is completed within a time in which the steel is maintained within a temperature range in which the steel has a sufficient formability for the forging.

The present invention thus reduces the resistance to deformation of a high strength steel and ensures a long tool life.

DESCRIPTION OF THE PREFERRED EMBODIMENTS

Preferably, the step of heating comprises heating the steel in the atmosphere at a heating rate of from 3° to 20° C./sec to a temperature within a range having a lower limit defined by a higher value selected from a temperature 45° C. below a solidus line in an equilibrium diagram and a temperature of 1250° C. and an upper limit defined by a temperature 20° C. below a liquidus line in the diagram and the step of forging comprises forging the heated steel either in a die at a working speed of 500 m/sec or higher or in a die preheated to a temperature of 200° C. or higher at a working speed of 200 m/sec or higher.

Figure 1:
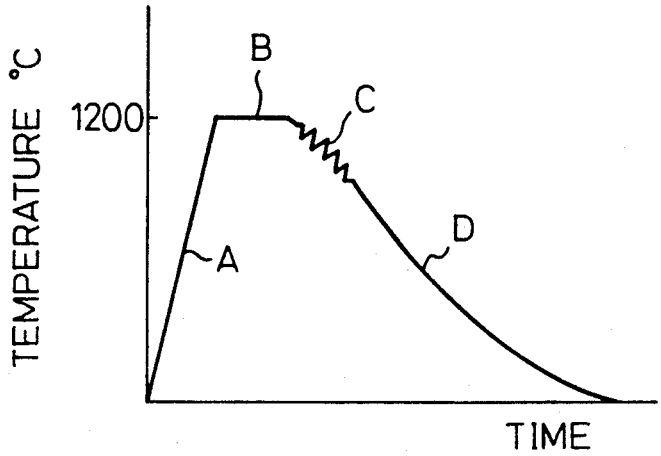
Fig. 1 PRIOR ART
FIG. 1 is a graph showing a time-temperature curve used in forging a steel by a conventional process.

FIG. 1 shows a typical time-temperature curve used in a conventional forging process, in which a steel is heated in step "A" usually to a temperature of about 1200° C. where it is held in step "B" for equalizing the temperature throughout the steel material, then forged in step "C" and naturally cooled in step "D" to an ambient temperature.

Figure 2:
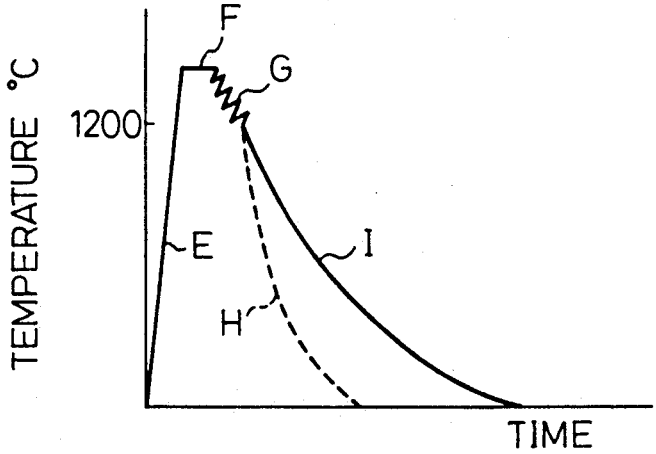
FIG. 2 is a graph showing a time-temperature curve used in forging a steel by a process according to an embodiment of the present invention.

FIG. 2 shows a time-temperature curve used in a forging according to the present invention, in which a steel is rapidly heated in step "E" to an ultrahigh temperature where it is held for a short time in step "F", then rapidly forged in step "G", and cooled to an ambient temperature by a forcible rapid cooling as shown by curve "H" shown by a broken line, or by a natural cooling as shown by curve "I" shown by a solid line.

According to the present invention, the heating step "E" is carried out in an atmosphere essentially composed of a non-oxidizing gas such as argon and nitrogen at a high heating rate, preferably 3° C./sec or more in average, by means of induction heating or any other rapid heating techniques. In addition to the use of a non-oxidizing atmosphere, the high heating rate further minimizes the oxidation of a steel caused by unavoidably accompanying oxidizing impurities in the non-oxidizing atmosphere gas when heated to an ultrahigh temperature, and thereby, improves the product yield and precision. To this end, the average heating rate is preferably 3° C./sec or higher. The average heating rate, however, is preferably not more than 20° C./sec to ensure a uniform heating over the steel volume, and thereby, prevent a partial melt-down of the steel material. The short time holding step "F" equalizes the temperature distribution over the heated steel volume and can be omitted when the heating step "E" alone provides a sufficient uniform temperature distribution.

A steel is heated to a temperature such that a steel has a sufficiently small deformation resistance or good formability during the subsequent forging step and that any minute fluctuation in temperature over the steel volume does not cause a partial melt-down of the steel material. Accordingly, the heating temperature is typically within a range having a lower limit defined by a higher value selected from a temperature 45° C. below the solidus line in an equilibrium diagram and a temperature of 1250° C. and having an upper limit defined by a temperature 20° C. lower than a liquidus line in the same diagram. The solidus and liquidus lines are determined by using a published binary- or ternary- equilibrium diagram of Fe-X or Fe-X1-X2 system; the symbols "X", "X1" and "X2" denotes a major alloying element of the steel concerned. The most authorized published equilibrium diagram book is known as "Binary Alloy Phase Diagram", M. Hansen, 1958, McGraw-Hill. The solidus and liquidus temperatures of a specific steel may be precisely corrected for minor elements by experiments, if necessary.

The forging according to the present invention is preferably carried out at an average working speed of 500 mm/sec in a forging die to advantageously prevent the steel material from being cooled by the die with a resulting increase in deformation resistance and decrease in formability. A forging die may be preheated to 200° C. or higher to mitigate the cooling of the steel by the die, and in this case, the working speed may be 200 m/sec or higher.

The heating temperature of the present invention is either within or slightly below a range in which said steel has a solid-liquid dual phase structure or is in a semi-molten state. To prevent a partial melt-down of the steel surface while ensuring good formability during forging, a steel is preferably heated in such a manner that the steel surface is in a solid state whereas the steel core has a solid-liquid dual phase or is in a semi-molten state.

The present inventive process has a wide field of application and is typically applied to automobile parts including engine equipment such as crankshafts and connecting rods, shaft couplings, transmission parts, and foot equipment, and accordingly, the steel material to be forged by the present inventive process is generally provided in the form of a round bar having a diameter, for example, of from about 20 to about 100 mm, a square bar having a side width, for example, of up to 100 mm, or other bars or blocks having a similar size.

The present inventive process may advantageously further comprise removing a surface oxide film from the heated steel while cooling the steel in a portion from 1 to 10 mm deep from the steel surface at a high cooling rate of 10° C./sec or higher to a temperature of 1200° C. or lower, the removing step being immediately followed by the step of forging.

Figure 3:
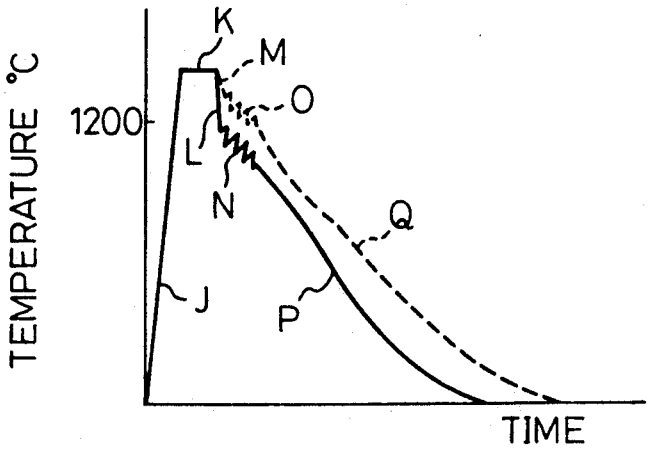
FIG. 3 is a graph showing a time-temperature curve used in forging a steel by a process according to another embodiment of the present invention.

FIG. 3 shows another time-temperature curve used in a forging process according to the present invention, the solid and broken lines representing the steel surface and core, respectively. A steel is induction-heated in step "J", held for a short time in step "K", blown with a gas jet to remove the surface oxide film thereof and simultaneously cool the steel surface along solid curve "L" and the steel core along broken curve "M", then forged in step "N"(surface) or "O"(core), and cooled so that the steel surface is rapidly cooled along solid curve "P" to a temperature of 1200° C. or lower while the steel core is normally cooled along broken curve "Q". The rapid cooling of the steel surface refines the steel structure in the surface layer and is preferably carried out at a surface cooling rate of 10° C./sec or higher to suppress possible oxidation of the steel. This rapid cooling should be effective within a surface layer to a depth of from 1 to 10 mm, i.e., a sufficient depth to provide an improved property of the forged product because of the refined structure while preventing an undesired reduction in formability of the whole steel volume because of an excessive increase in deformation resistance of the surface layer. This rapid cooling of the steel surface may be effected by blowing pressurized air, nitrogen, or other gaseous medium, a liquid medium such as water, or a solid medium.

The present inventive process may also advantageously further comprise maintaining the steel forged to the desired extent of forming, at a lower dead point of a forging stroke under a load of 10% or more of a maximum load applied during the forging until the steel temperature, at least in the steel surface layer, is lowered to 1000° C. or lower. This maintenance step advantageously prevents the precision of the forged product from being degraded because of large thermal distortion occurring when an ultrahigh temperature forging is completed in a very short time. When the steel temperature, at least in the surface layer, is lowered to 1000° C. or lower, a large thermal distortion does not occur. A load of 10% or more of a maximum forging load sufficiently suppresses thermal distortion.

Instead of the above-mentioned step, the present inventive process may still advantageously further comprise rapidly cooling the steel forged to the desired form, at a cooling rate of 5° C./sec or higher until the steel, at least on the surface thereof, is cooled to 800° C. or lower. Both the cooling rate of 5° C./sec or higher and the cooling termination temperature of 800° C. or lower suppress a possible oxidation of the steel because of a residual oxidizing impurities in the atmosphere of a non-oxidizing gas.

A steel used in the present inventive process usually consists, in wt %, of:

C: 0.1 or more and less than 1.0,
Si: 0.1–1.5,
Mn: 0.15–2.0,
Ni: 3.5 or less,
Cr: 1.5 or less,
Mo: 0.5 or less, and
the balance consisting of iron and unavoidable impurities.

The carbon content is limited to less than 1.0 wt % to ensure a good toughness. Carbon, however, is usually present in the present inventive steel in an amount of 0.1 wt % or more to provide necessary strength.

Silicon, when present in an amount of 0.1 wt % or more, serves as an essential deoxidizer in the steelmaking process and effectively improves the steel strength but should not be contained in an amount of more than 1.5 wt % to ensure a good toughness.

Manganese, like silicon, is also effective for deoxidation and strengthening but the amount should be limited to not more than 2.0 wt % to ensure a good toughness.

Nickel improves the toughness but further improvement is not obtained when contained in an amount of more than 3.5 wt %.

Chromium improves the strength but lowers the toughness when present in an amount of more than 1.5 wt %.

Molybdenum improves the toughness but further improvement is not obtained when contained in an amount of more than 0.5 wt %.

EXAMPLE 1

Experiments were carried out by using the steel samples having the chemical composition as stated in Table 1 both in a process according to the present invention and in a comparative process. Table 1 also shows the solidus and liquidus temperatures of the sample steels, read from an Fe-C binary phase diagram.

TABLE 1

| Sample | Chemical composition (wt %) | | | | | Solidus | Liquidus |
|---|---|---|---|---|---|---|---|
| No. | C | Si | Mn | P | S | (°C.) | (°C.) |
| K | 0.29 | 0.24 | 0.22 | 0.018 | 0.017 | 1450 | 1507 |
| L | 0.53 | 0.20 | 0.78 | 0.013 | 0.016 | 1396 | 1487 |
| M | 0.83 | 0.29 | 0.53 | 0.010 | 0.009 | 1302 | 1465 |

30 mm in dia, 45 mm long steel samples were heated to and held at predetermined temperatures and forged by longitudinal compression at different compression speeds with no lubrication. The heating was carried out at a heating rate of 5° C./sec by an induction heater in a nitrogen gas atmosphere in a process according to the present invention, and in a comparative process, at a heating rate of 2° C./sec in the ambient air.

In all of the experiments hereinafter described, the holding time was commonly 2 min, the steel surface temperature was monitored by an infrared radiation thermometer, and the forging press used had a hydraulic servomechanism to control the ram speed and maintain a constant load. A non-oxidizing atmosphere was established by flowing a nitrogen or argon gas through an induction coil surrounded by a heat-insulating jacket.

After the forging, an enlargement ratio of a sectional area perpendicular to the sample axis was determined as summarized in Table 2.

TABLE 2

| Sample No. *1 | Steel | S *2 °C./sec | Atmosphere | Heating Temp. °C. | V *3 mm/sec | α *4 |
|---|---|---|---|---|---|---|
| 1 | K | 5 | Nitrogen | 1420 | 500 | 2.4 |
| 2 | K | 5 | Nitrogen | 1480 | 500 | 3.8 |
| C1 | K | 2 | Air | 1230 | 500 | 1.5 |
| 3 | L | 5 | Nitrogen | 1440 | 500 | 6.5 |
| 4 | L | 5 | Nitrogen | 1390 | 500 | 2.8 |
| C2 | L | 2 | Air | 1230 | 500 | 1.7 |
| C3 | L | 2 | Air | 1480 | 300 | 1.9 |
| C4 | L | 2 | Air | 1300 | 300 | 1.2 |
| 5 | L | 5 | Nitrogen | 1430 | 1000 | 7.7 |
| 6 | L | 5 | Nitrogen | 1370 | 1000 | 3.5 |
| 7 | M | 5 | Nitrogen | 1390 | 500 | 7.3 |
| 8 | M | 5 | Nitrogen | 1340 | 500 | 2.7 |
| C5 | M | 2 | Air | 1200 | 500 | 1.6 |

(Note)
*1 C: comparative samples, others present inventive samples,
*2 S: heating rate,
*3 V: compression speed.
*4 α: enlargement ratio of a sectional area.

A distinct difference can be seen from Table 2 between the present inventive process and the conventional process in that the former provides an enlargement ratio α greater than 2.0 whereas the latter only provides an α value of less than 2.0, under the same compression load. It can also be seen that the formability of steel is remarkably increased as the working speed S is increased from 300 through 500 to 1000.

The formation of an oxide film on the steel surface was compared for some processes as shown in Table 3. The present inventive process "2" using a rapid heating rate of 5° C./sec and a non-oxidizing atmosphere of nitrogen gas formed a 17 μm thick oxide film, whereas the comparative process "C6" using a lower heating rate of 1° C./sec formed a 120 μm thick film and the comparative process "C7" using an atmosphere of air formed a 200 μm thick film. The inventive sample "13" demonstrates that the surface oxide film had a further reduced thickness of 12 μm when a steel was rapidly cooled after forging at a rate of 8° C./sec by a pressurized air blow. The other samples were naturally cooled after forging.

TABLE 3

| Sample No. | Steel | Heating temp. °C. | S °C./sec | Atmosphere | V mm/sec | Oxide film thickness μm |
|---|---|---|---|---|---|---|
| 2 | K | 1480 | 5 | Nitrogen | 500 | 17 |
| C6 | K | 1480 | 1 | Nitrogen | 500 | 120 |
| C7 | K | 1480 | 5 | Air | 500 | 200 |
| 13 | K | 1480 | 5 | Nitrogen | 500 | 12 |

Table 4 summarizes the toughness data of the inventive samples produced when the steel surface was rapidly cooled and then forged, together with data of the samples not rapidly cooled.

The data of the inventive sample "3" are also shown for comparison, which was not rapidly surface-cooled and had an impact value of 1.2 kgf-m/cm$^2$ determined at room temperature by using a JIS No. 4 test piece. The inventive sample "9", which was rapidly surface-cooled at a rate of 15° C./sec until the surface layer to a depth of 6 mm was cooled to a temperature below 1200° C. and then forged, had a remarkably improved impact value of 10.1 kgf-m/cm$^2$. The comparative sample "C3", which was made of the same steel "L" as the inventive samples "3" and "9", heated at a rate of 2° C./sec in air, and forged at a working rate of 300 mm/sec, had a very poor impact value of 0.3 kgf-m/cm². Thus, the rapid surface cooling before forging significantly improves the toughness of the forged product.

TABLE 4

| Sample No. | Heating temp. °C. | S °C./sec | Atmosphere | V mm/sec | T °C./sec | D mm | Impact value kgf-m/cm² |
|---|---|---|---|---|---|---|---|
| 3 | 1440 | 5 | Nitrogen | 500 | — | — | 1.2 |
| 9 | 1440 | 5 | Nitrogen | 500 | 15 | 6 | 10.1 |
| C3 | 1480 | 2 | Air | 300 | — | — | 0.3 |

(Note)
T: cooling rate to a temperature below 1200° C.
D: cooled depth

In Table 5, the inventive sample "10" was forged at a working speed of 230 mm/sec with a forging die preheated at 220° C. under the conditions provided in Table 5; the other conditions being the same as those used for the samples shown in Table 2. A good sectional enlargement ratio of 2.9 was obtained, compared with the comparative sample "C3".

TABLE 5

| Sample No. | Steel | S °C./sec | Atmosphere | Heating temp. °C. | V mm/sec | α |
|---|---|---|---|---|---|---|
| 10 | L | 5 | Argon | 1420 | 230 | 2.9 |
| C3 | L | 2 | Air | 1480 | 300 | 1.9 |

Table 6 summarizes the data obtained in a experiment in which a load was maintained on a forged material at a lower dead point, together with a comparative sample in which this load maintenance was not effected. A 50 mm dia., 138 mm long sample was gripped in the lower length of 60 mm and the remaining upper length was upset in a 70 mm dia. die. At the same time as the upsetting was completed, a load of 10% of the maximum upsetting load was applied to the sample and maintained until the sample was cooled to a temperature as stated in Table 6. It can be clearly seem from Table 6 that, in the inventive samples "11" and "12", the load maintenance after the completion of forging provided a maximum upset diameter having a reduced dimensional error of less than half that obtained by the comparative sample "C8", in which a load was not maintained after the completion of upsetting.

TABLE 6

| Sample No. | Steel | S °C./sec | Atmosphere | Heating temp. °C. | Q °C. | Upset dia. (max) mm | Shortage mm |
|---|---|---|---|---|---|---|---|
| 11 | K | 5 | Argon | 1470 | 900 | 69.3 | −0.7 |
| 12 | K | 5 | Argon | 1470 | 600 | 69.6 | −0.4 |
| C8 | K | 2 | Air | 1460 | — | 68.5 | −1.5 |

(Note)
Q: material temperature at which the load maintenance was terminated.

A steel having an excessive carbon content of 1.30 wt %, the gross composition being shown in Table 7, was forged under the same condition as that used for the inventive sample "3" shown in Table 4, except that a lower heating temperature of 1250° C. was used according to the lower solidus and liquidus temperatures of the steel. The forged sample had too poor an impact value of 0.2 kgf-m/mm² to be applied for machine parts.

TABLE 7

| Sample No. | Chemical composition (wt %) C | Si | Mn | P | S | Solidus (°C.) | Liquidus (°C.) |
|---|---|---|---|---|---|---|---|
| N | 1.30 | 0.25 | 0.75 | 0.015 | 0.011 | 1230 | 1420 |

Although the above-described examples used those steels that are classified in the grade of a carbon structural steel, it will be clearly understood that the present invention may be unlimitedly applied to the forging of other steels classified in the alloyed structural steel grade containing some major alloying or strengthening elements, such as nickel, chromium and molybdenum, other than carbon and thereby having a higher resistance to deformation at elevated temperatures, as represented by JIS SCM435, JIS SCr420 and the like.

As hereinabove described, the present invention improves the formability of steel materials, thereby elongates the tool life and enables high precision forming of materials having a complicated shape and/or a high strength, which was not conventionally successfully performed, while ensuring that the product has a good mechanical property including strength and toughness. The present invention thus makes a great contribution to weight reduction of machine parts and the improvement of automobile fuel efficiency.

We claim:

1. A process of hot forging a steel at an ultrahigh temperature, comprising the steps of:

heating a steel containing less than 1 wt % carbon in an atmosphere substantially composed of a non-oxidizing gas at a high heating rate sufficient for suppressing the oxidation of said steel caused by a residual oxidizing impurity gas in said atmosphere to a temperature either within or slightly below a range in which said steel has a solid-liquid dual phase structure; and forging the heated steel in a hot forging die at a high working speed in accordance with a preheating temperature of said die so that said steel is maintained at a temperature necessary for imparting said steel with a formability necessary for effecting said forging until a desired form is attained.

2. A process according to claim 1, wherein said step of heating comprises heating said steel in said atmosphere at a heating rate of from 3° to 20° C./sec to a temperature within a range having a lower limit defined by a higher value selected from a temperature 45° C. below a solidus line in an equilibrium diagram and a temperature of 1250° C. and an upper limit defined by a temperature 20° C. below a liquidus line in said diagram and said step of forging comprises forging the heated steel either in a die at a working speed of 500 m/sec or higher or in a die preheated to a temperature of 200° C. or higher at a working speed of 200 m/sec or higher.

3. A process according to claim 1 or 2, wherein said steel consists, in wt %, of:

C: 0.1 or more and less than 1.0,
Si: 0.1–1.5,
Mn: 0.15–2.0,
Ni: 3.5 or less,
Cr: 1.5 or less,
Mo: 0.5 or less, and
the balance consisting of iron and unavoidable impurities.

4. A process according to claim 1 or 2, which further comprises:

removing a surface oxide film from said heated steel while cooling said steel in a portion from 1 to 10 mm deep from the steel surface at a high cooling rate of 10° C./sec or higher to a temperature of 1200° C. or lower, the removing step being immediately followed by said step of forging.

5. A process according to claim 1 or 2 wherein said steel has a surface layer, which further comprises:

maintaining said steel forged to said desired form, at a lower dead point of a forging stroke under a load of 10% or more of a maximum load applied during said forging until the steel temperature, at least in the steel surface layer, is lowered to 1000° C. or lower.

6. A process according to claim 1 or 2, which further comprises:

rapidly cooling said steel forged to said desired form, at a cooling rate of 5° C./sec or higher until the steel, at least in the surface thereof, is cooled to 800° C. or lower.

* * * * *